US005572741A

United States Patent [19]

Bowman

[11] Patent Number: 5,572,741

[45] Date of Patent: Nov. 12, 1996

[54] FIREFIGHTER'S GARMENT WITH LABEL PROTECTOR

[75] Inventor: J. Robert Bowman, Hooksett, N.H.

[73] Assignee: Globe Manufacturing Company, Pittsfield, N.H.

[21] Appl. No.: 441,593

[22] Filed: May 15, 1995

[51] Int. Cl.[6] ..... A41D 13/00

[52] U.S. Cl. ..... 2/81; 2/244; 2/246; 40/586; 40/626; 40/630; 283/107; 428/13; 428/102

[58] Field of Search ..... 2/81, 244, 245, 2/246; 40/586, 626, 630; 156/91, 305; 283/107, 109, 110; 428/13, 46, 102

[56] References Cited

U.S. PATENT DOCUMENTS 5,443,875 8/1995 Liu ..... 2/272

*Primary Examiner*—Diana Biefeld

*Attorney, Agent, or Firm*—Watson Cole Stevens Davis

[57] ABSTRACT

A label having indicia thereon is attached to the shell of a firefighter's garment by stitching which passes through the label and the shell, with portions of the stitching extending outwardly of the label. A transparent protective layer is adhesively secured to the label and covers the outer surface of the label and the outwardly extending stitching portions. The protective layer is heat and abrasion resistant and is substantially waterproof.

6 Claims, 1 Drawing Sheet

FIREFIGHTER'S GARMENT WITH LABEL PROTECTOR

BACKGROUND OF THE INVENTION

A firefighter's garment such as a cost usually has a label attached thereto. The label has information printed thereon as well as warnings and washing instructions. In addition, the label includes blank spaces which are filled in with indicia after the label is stitched in place on the coat indicating, for example, size, length, cut, serial number and the date.

These labels are usually placed in such a location that: they are not directly exposed to the environmental conditions encountered while fighting fires, such as on the inner side of a flap on the coat. However, the labels are exposed to heat and water, and movement of the flap portion relative to the adjacent portion of the coat causes abrasion of the label. These factors combine to cause the indicia to become illegible. This makes it difficult to track a particular garment. Accordingly, it is desirable to provide means to prevent the indicia on a label from becoming illegible over a period of time.

The stitching which holds the label in place also tends to be damaged by firefighting activities, and it is therefore also desirable to provide a means to protect the stitching holding the label in place.

SUMMARY OF THE INVENTION

The present invention provides a transparent protective layer over the label which is resistant to heat and abrasion and which is substantially waterproof. The protective layer is secured to the label by a layer of adhesive material, the protective layer being disposed over the label and the stitching so that both the label and the stitching are protected during use of the garment.

The invention utilizes a protective film formed of a biaxially oriented copolymer film, and more particularly a film of KAPTON manufactured by E. I. DuPont de Nemours Co., Wilmington, Del. This material has the desired physical characteristics as discussed above and is transparent such that the indicia on the label can be readily read when desired.

DESCRIPTION OF THE PREFERRED EMBODIMENT

Figure 1:
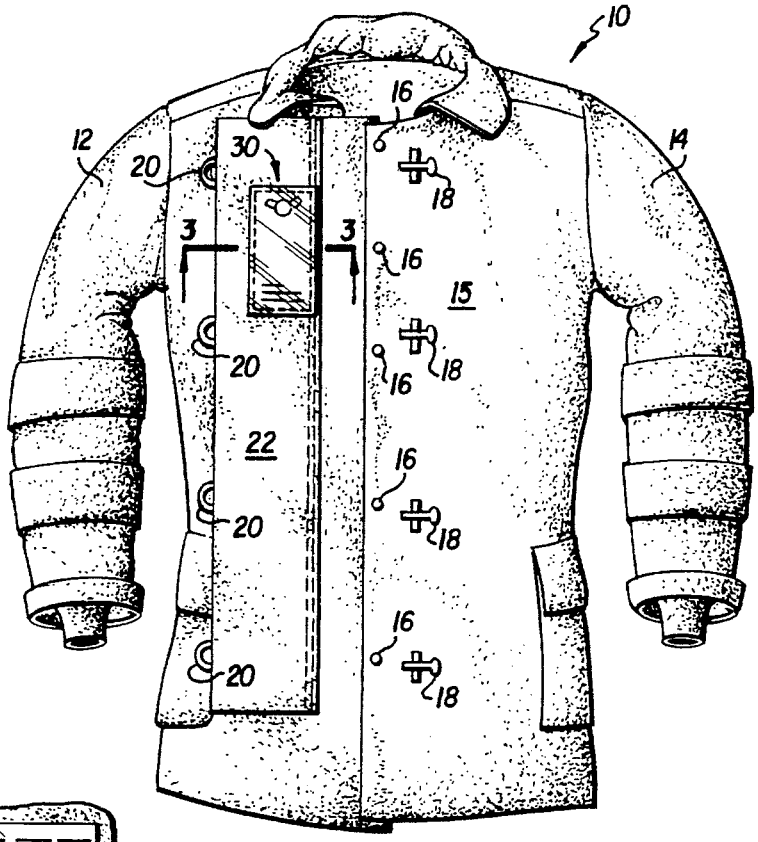
FIG. 1 is an elevation of a firefighter's jacket having a label attached thereto.

Referring now to the drawing wherein like reference characters designate corresponding parts throughout the views, there is shown in FIG. 1 a conventional firefighter coat 10 formed of fire retardant material and having arms 12 and 14 and a torso portion 15. A plurality of snap fasteners 16 are provided for connecting the two edges of the torso portion to one another. A plurality of hook fasteners 18 attached to the torso portion are adapted to engage a corresponding plurality of D-rings 20 attached to an outside storm flap 22, the storm flap being shown in open position.

Figure 2:
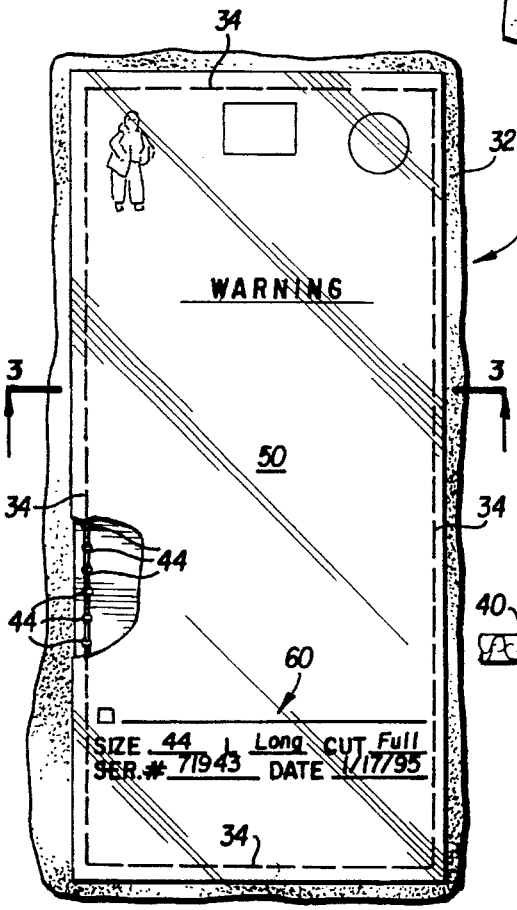
FIG. 2 is an enlarged view of the label and a portion of the sheet of material to which it is attached.
Figure 3:
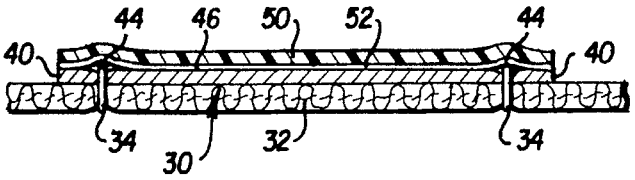
FIG. 3 is a section on an enlarged scale taken on line 3—3 of FIG. 2.

A label indicated generally by reference numeral 30 is attached to the surface of the flap which faces inwardly when the storm flap is in operative position with fasteners 18 connected to D-rings 20. The label may be formed of a material similar to that of the coat, but is provided in a form similar to paper so that it can be readily printed on with desired information and so that indicia can be marked thereon when desired. As seen in FIGS. 2 and 3, the label is attached to a sheet of material 32 of the outside storm flap by stitching 34 which is spaced inwardly from the outer periphery 40 of the label. The stitching includes portions 44 which extend outwardly of the outer surface 46 of the label.

Protective layer 50 is formed of KAPTON as previously discussed and has a layer of adhesive material 52 disposed on the undersurface thereof which is substantially coextensive with the protective layer. The protective layer is substantially coextensive with the label. In other words, the edges of the label, the protective layer and the adhesive layer are substantially aligned with one another, although the outer edges of the protective layer may be disposed slightly outwardly of the outer edge of the label to provide maximum protection.

It will be noted as seen in FIG. 3 that the protective layer 50 extends to a point adjacent the outer peripheral edge of the label and is secured to the label outwardly of the stitching all the way around the label so that the stitching as well as the outer surface 46 of the label is well-protected by the protective layer.

As seen in FIG. 2, protective layer 50 is transparent such that any printing on the label as well as any indicia 60 which may be marked on the label are readily visible through the protective layer.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. A firefighter's garment comprising an outer shell formed of fire retardant material and including a sheet of material having a surface, a label including an inner surface disposed adjacent said surface of the sheet of material and an outer surface having indicia thereon, stitching extending through said label and said sheet of material for attaching said label in place on said surface of the sheet of material, said stitching including portions extending outwardly of said outer surface of the label, and a transparent protective layer secured to said label and covering said outer surface of the label and said stitching portions, said protective layer being heat and abrasion resistant and being substantially waterproof.

2. A garment as defined in claim 1 wherein said protective layer is adhesively secured to said label.

3. A garment as defined in claim 1 including a layer of adhesive material between said protective layer and said outer surface of the label for securing the protective layer to the label.

4. A garment as defined in claim 3 wherein said label includes an outer peripheral edge, said stitching being spaced inwardly from said outer peripheral edge, said layer of adhesive material extending to a point adjacent said outer peripheral edge to completely cover and protect said stitching.

5. A garment as defined in claim 1 wherein said protective layer comprises a biaxially oriented copolymer film.

6. A garment as defined in claim 1 wherein said protective film comprises a polyimid film.

* * * * *